United States Patent [19]

Colgate

[11] Patent Number: 4,483,399

[45] Date of Patent: Nov. 20, 1984

[54] METHOD OF DEEP DRILLING

[76] Inventor: Stirling A. Colgate, 4616 Ridgeway, Los Alamos, N. Mex. 87544

[21] Appl. No.: 233,849

[22] Filed: Feb. 12, 1981

[51] Int. Cl.[3] ..... E21B 7/20; E21B 23/04

[52] U.S. Cl. ..... 166/308; 166/55; 166/207; 175/72; 175/171

[58] Field of Search ..... 175/72, 171; 166/297, 166/55, 55.1, 63, 207, 283, 281, 307, 308; 102/319, 322

[56] References Cited

U.S. PATENT DOCUMENTS

| | | | |
|---|---|---|---|
| 1,233,888 | 7/1917 | Leonard | 166/207 |
| 1,880,218 | 10/1932 | Simmons | 166/207 |
| 2,214,226 | 9/1940 | English | 166/207 |
| 2,447,629 | 8/1948 | Beissinger et al. | 166/207 |
| 2,583,316 | 1/1952 | Bannister | 166/207 |
| 3,188,850 | 6/1965 | Lintricum et al. | 72/393 |
| 3,228,469 | 4/1966 | Kern et al. | 175/72 |
| 3,409,093 | 11/1968 | Cunningham et al. | 175/72 |
| 3,616,855 | 11/1971 | Colgate | 166/283 |
| 3,973,628 | 8/1976 | Colgate | 166/283 |

*Primary Examiner*—James A. Leppink
*Assistant Examiner*—Hoang C. Dang
*Attorney, Agent, or Firm*—Brumbaugh, Graves, Donohue & Raymond

[57] ABSTRACT

Deep drilling is facilitated by the following steps practiced separately or in any combination:

(1) Periodically and sequentially fracturing zones adjacent the bottom of the bore hole with a thixotropic fastsetting fluid that is accepted into the fracture to overstress the zone, such fracturing and injection being periodic as a function of the progression of the drill.

(2) Casing the bore hole with ductile, pre-annealed casing sections, each of which is run down through the previously set casing and swaged in situ to a diameter large enough to allow the next section to run down through it.

(3) Drilling the bore hole using a drill string of a low density alloy and a high density drilling mud so that the drill string is partially floated.

15 Claims, 4 Drawing Figures

FIG. 1
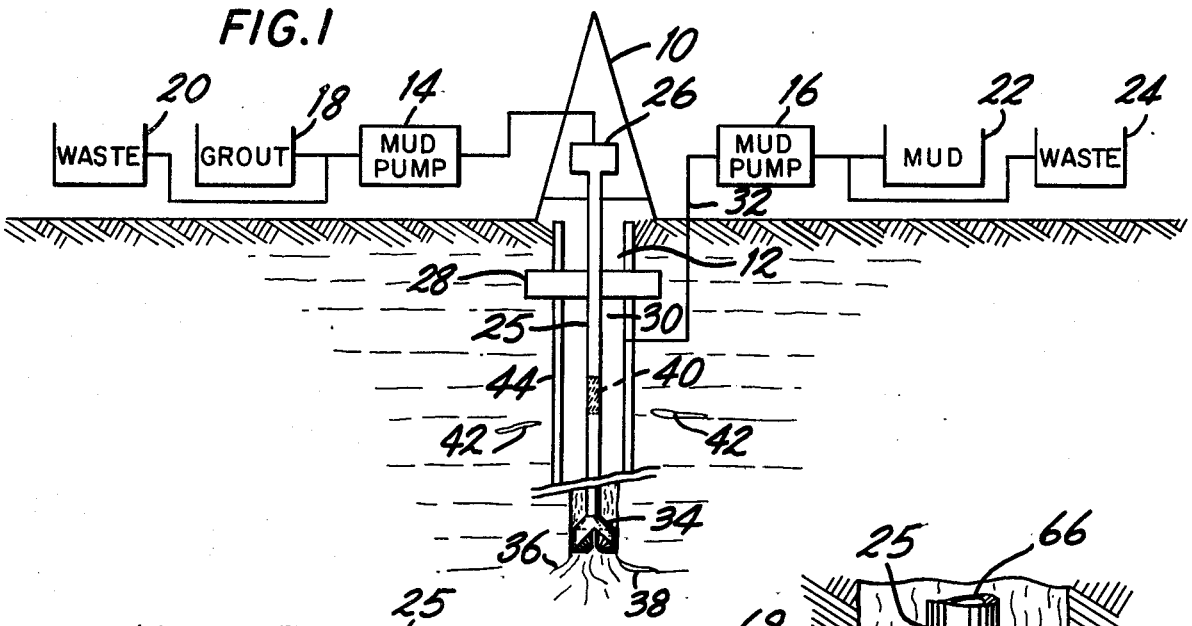
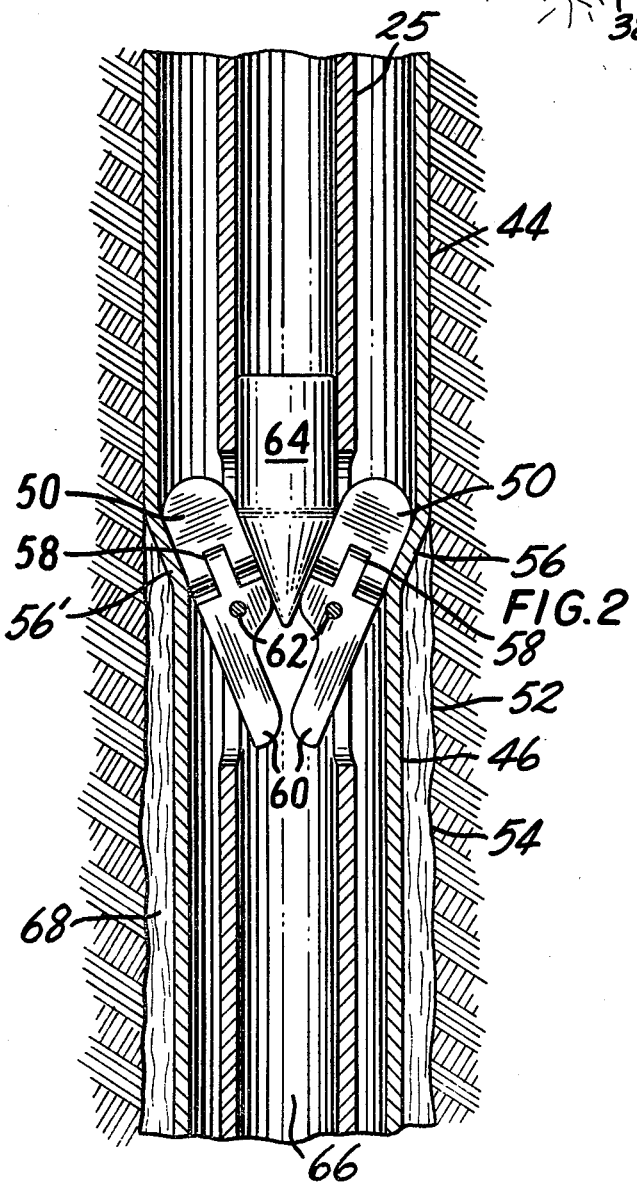
FIG. 2
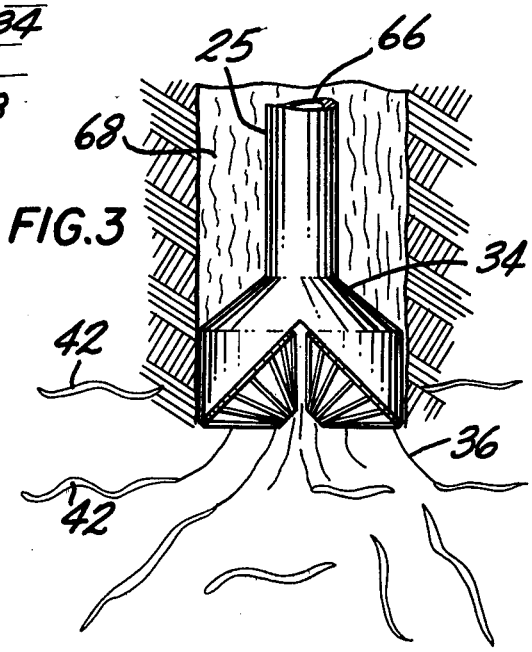
FIG. 3
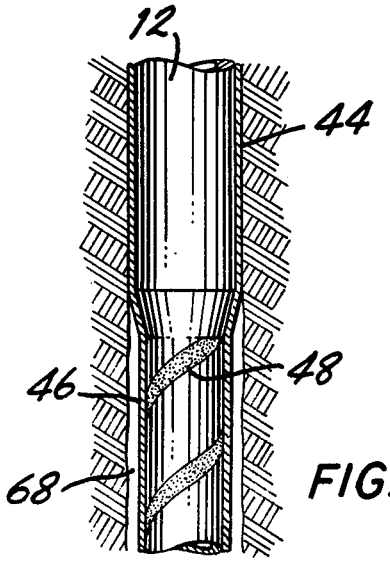
FIG. 4

METHOD OF DEEP DRILLING

BACKGROUND OF THE INVENTION

This invention relates to petroleum wells, and more particularly, to completing a well to a petroleum bearing formation lying deep within the earth.

The Government has rights in this invention pursuant to Contract No. W-7405-ENG 36 (S-53, 311 and W(I)-112-79) awarded by the U.S. Department of Energy.

The ever increasing demand for energy has created an equivalent demand for deep drilling. The search for liquid or gaseous fuels at depths of 30,000 feet is now possible, but frequently drilling must be terminated at depths far less than this, not just because of equipment failures, but because of geological conditions that frustrate current technology.

The technological limitations to deep drilling include the following: (1) the loss of circulation, i.e. drilling fluid loss into the formation; (2) geopressurized zones that cause the blowout of the drilling fluid and drill string and consequent destruction of the rig; (3) excess weight of the drill string; and (4) the necessary sequential stepping down in size of the casing.

The most common failure in drilling is the loss of circulation due to the drilling fluid breaking into the surrounding formation. A drilling mud of high density is desirable because it can cap or contain any gas deposits with a static head pressure corresponding to its density and column height. On the other hand, many zones are far weaker than the mud pressure and will fracture with consequential loss of the drilling mud into the formation. In addition when drilling, the drilling fluid must circulate at relatively high velocity in order to carry away the cuttings and, at the same time, cool and lubricate the drilling bit. At great depths, where the temperature becomes high, the cooling requirement becomes paramount, and the required velocity of the fluid is large. The two conditions of a very long return path length of the mud between the drill stem and the casing wall and the high velocity of the mud mean that there will be a large pressure drop due to fluid flow friction. This circulation pressure drop, of course, also occurs inside the drill string on the way down to the drill bit, but the strength of the drill pipe contains this fraction of the circulation pressure drop. The remaining fraction of the circulation pressure drop must add to the hydrostatic head of the mud, and therefore increases the likelihood of wall fracture and fluid loss. Very often the balance between these pressures is highly critical, and the rate of drilling may be severely constrained or even terminated because of the inability to find a satisfactory mud density that allows for containment, circulation, and lack of fluid loss.

Geopressurized zones are important in the development of petroleum reserves because there is good reason to believe the bulk of future hydrocarbon reserves may be located in such formations. A geopressurized zone is one where the pressure of the contained fluid or gas is roughly equal to the overburden pressure. Overburden pressure corresponds to the weight of the overlying strata or rocks. It generally corresponds to 1 psi per foot of depth at a mean density of 2.0. Most rock at intermediate depths is porous, and the pores are filled with water. The hydrostatic head of this water is one half that of the overburden rock, and sometimes it is significantly less than this because the water table may not reach to the surface. Any trapped hydrocarbons will in general be at a pressure corresponding to the hydrostatic head of the water and hence, one half that of the overburden pressure. The rock strength surrounding the pores supports the difference in pressure between overburden pressure and pore pressure. When this difference in pressure becomes greater than the particular rock strength, a pore fluid of different pressure than the overburden cannot easily exist, and the tendency is for the rock at greater depth to become dense without a separate pore phase. If a gas or fluid is trapped at this depth, then it is likely to come into pressure equilibrium with the overburden pressure of the rock and form a geopressurized zone. Since this pressure is likely to be considerably greater than the hydrostatic drilling fluid pressure, the pressure may force the drilling apparatus rapidly up the well bore, causing a "blowout".

SUMMARY OF THE INVENTION

The present invention provides techniques that can be practiced separately or in any combination for facilitating deep drilling, as follows:

(1) Periodically and sequentially fracturing zones adjacent the bottom of the bore hole with a thixotropic fastsetting fluid that is accepted into the fracture to overstress the zone, such fracturing and injection being periodic as a function of the progression of the drill.

(2) Casing the bore hole with ductile, pre-annealed casing sections, each of which is run down through the previously set casing and swaged in situ to a diameter large enough to allow the next section to be run down through it.

(3) Drilling the bore hole using a drill string of a low density alloy and a high density drilling mud so that the drill string is partially floated.

DETAILED DESCRIPTION OF THE INVENTION

The primary difficulty with deep drilling is the weakness of the rock surrounding the hole. At shallower depths, the mechanical strength of the rock is sufficient, say a few thousand psi, to allow the use of mud pressure somewhat above the local acceptance pressure. Acceptance pressure is the least principle stress in the formation and, hence, is the pressure at which the rock will accept a low viscosity fluid after the formation has been fractured. At intermediate depths, greater than a few thousand feet, where the overburden pressure is greater than the mechanical strength of the formation, the acceptance pressure or least principle stress is characteristically $\frac{2}{3}$ of the overburden pressure. Hence, if a fracture is formed or intersected, fluid loss will occur at downhole pressures significantly less than overburden. In order to circumvent this limitation to deep drilling, it is desirable to increase the strength of the formation locally in the neighborhood of the drill hole. Overstressing, or strengthing of the rock, is the objective of the process called Stress Field Engineering. This is accomplished by pumping a thixotropic fast setting fluid at a high pressure, first to fracture the formation, and then to slow pump a finite volume with static periods or holds so that the fluid or special grout will thicken with a finite gel strength so that later pumping or increase in pressure will not cause further flow in the given fracture, but instead the fluid will find or form a new fracture. In this fashion incremental volumes are added sequentially and locally. The local compression of the formation by these added volumes results in a stress. This stress can be made arbitrarily large by the continuation of the sequential pumping and sequential holds. Since the stress can be made arbitrarily large, it can be made greater, and indeed in practice many times greater, than overburden pressure, and hence "overstressed". The overstressed material should have a sufficiently high strength that the casing string can support an internal pressure in excess of about 1.33 times the overburden pressure at the bottom of the hole. In general the incremental volume required to reach practical values of overstress is small compared to the volume affected, because the bulk modulus of most formations is very large compared to the overburden stress; otherwise, the formation would collapse due to gravity.

Overstressing of a drill hole is, in the preferred embodiment, performed in step with drilling; otherwise, if the drill penetrates an unstressed formation, uncontrolled fluid loss may occur. Therefore, semi-continuous stressing is to be performed such that the overstressed region leads the drill bit. Fortunately, the process of overstressing naturally lends itself to accomplish this. When the overstressing fluid, preferably a thixotropic grout, is forced into the formation, it always flows where the least principle stress is least, i.e., it goes where it is easiest. If the hole has been overstressed down to the bit, then a further stress fluid injection will tend to flow ahead where there is less stress and it is easiest. The volume of stress fluid to be pumped each injection is small, some few meters of hole length, and must be repeated some dozen times within the period for the progression of the drill for the same distance. The overstressing injection, then, is performed fairly often. It is therefore necessary for the drilling fluid return flow, commonly known as mud return, to be periodically shut-in, i.e. pressurized, when a segment of grout has reached bottom hole, i.e. spotted at the drill bit. This back pressure or shut-in pressure should be periodically as high as the maximum overstress desired. Since this in turn should be roughly the overburden pressure, so that the down hole pressure is roughly twice overburden, provision must be made for mud return shut-in pressures greater than 30,000 psi. This means that the drill stem mud return gland or collar as well as the "Kelly" that injects mud into the drill stem must be made especially sturdy. In addition, the drilling should be performed with a significant constant back pressure on the mud so that any loss in pressure, interpreted as fluid loss, can signal the need for further overpressuring, as well as permit a temporary correction of fluid loss by a reduction in back pressure. This allows a continuous monitoring of the existing overstress at the drill face, and at the same time, allows for drilling during the time it takes to spot new overstress fluid at bottom hole. Therefore, reversible high pressure mud pumps must be used on both sides, Kelly and mud return, of the system. A reversible pump means that it can be used for controlled let-down of the pressure as well as the usual forward mode. This allows controlled spotting, pressurized circulation, and high pressure backout. Finally, in order to insure that the overstress fluid spotted at the bottom of the hole is the fluid that is injected into the formation and not the mud being injected into some weaker point above, the hole must be cased down to some tens of meters above bottom hole. The maximum length between drill bit and casing should not be significantly larger than the typical length of the overstress grout increment; otherwise, there would be a significant possibility for mud rather than thixotropic grout injection if a weaker point should occur where mud rather than grout contacted the uncased hole. This special requirement for a semi-continuous casing of the hole will require the technique of in situ swaging or expanding of the casing into place, and will be discussed further herein.

When a volume of gel is injected into a formation, it will flow along a fracture until the stress created by the extent and width of the filled fracture is equal to the pressure drop due to the displacement of the gel along the fracture. The pressure drop due to the movement of the gel along a fracture of width w, radius r, and gel strength Gs is:

$$P=2Gsr/w.$$

The normal stress will be that created by an increment of volume rwh where h is the extent of the fracture normal to r, added to a volume effected by the fracture or about $(\pi)r^2h$. The stress created is then:

$$\tau=Brwh/\pi r^2h$$

where B is the bulk modulus. Then equating $P=(\tau)$, we have:

$$w = r\left[\frac{2(\pi)\ Gs}{B}\right]^{\frac{1}{2}}$$

and the increment of stress added each fracture and hold becomes:

$$d\tau=(2GsB)^{\frac{1}{2}}.$$

Rewriting the last equation to solve for Gs, $Gs=(d\tau)^2/2B$. Thus, for typical gel strengths of several psi and moduli of several $10^6$ psi, one can expect a stress increment of several thousand psi per injection and crack widths w of $3\times10^{-3}$. Similarly, if it is desired to add an increment of stress of several thousand PSI per injection, a fluid having a gel strength of several PSI is chosen. The extent of the fracture is determined by the volume pumped in each injection. This becomes:

$$r=\text{volume}/(wh)=(300\ \text{vol}/h)^{\frac{1}{2}}.$$

If one is concerned with a disc-shaped region where h=r, i.e., where the length of the hole affected equals the fracture length, then $r=(300\ \text{vol})^{\frac{1}{3}}$.

The above estimates assume that a fracture propagates with negligible pressure drop at the crack tip. This may not be the case, because of the variability of the formation, and then the increment of $\tau$ per injection, is increased accordingly as well as the crack width and volume. In the case of deep drilling say to a depth of 30,000 feet, it is desired that the overstress be about the same, as the overburden pressure, or about 30,000 psi. About 2 to 10 sequential injections are required in each meter of the bore hole. Each injection may add several thousand psi, and overstressing is begun when the drill has penetrated to regions of roughly one half (15,000 psi) of the mean overstress (30,000 psi) desired.

The radius to which the drill hole can be stressed should be such as to give secure support to the casing for even the most extreme geopressurized zones. This implies a radius that is some multiple of the hole diameter such that the hole itself is a small perturbation within the overstressed region. In a preferred embodiment, the radius of the overstressed region is 10 times that of the hole, thereby providing sufficient area with an adequate safety factor. One would then need to pump a total volume of stress fluid or thixotropic grout of several times the volume of the drill hole. If the radius of the overstressed region is 10 times that of the hole, the volume of the overstressed formation is 100 times larger than the volume of the hole. If one adds an increment of 1% to the formation, then the stress is increased by 1% of the bulk modulus, or by roughly 20,000 psi. The cost of a special grout such as neat cement and plaster (calcium sulfate) is trivial compared to the cost of drilling.

The drill hole diameter is frequently determined by the need to step the size of the casing so that one segment can be slipped through the previous one and then cemented into place. Because of the need continuously to case relatively close to bottom hole in order to localize the overstressing to newly drilled hole, a casing procedure is suggested of swaging the casing after implacement, so that the placement stepping requirement is circumvented. The stepping of the casing diameter is also specified so that the increment of pressure at the bottom of the hole due to the required circulation velocity of the mud is kept small; otherwise, the return circulation back pressure will add to the probability of formation breakdown and loss of drilling fluid. In one embodiment of the present invention, the entire hole is overstressed to a value equal to the highest expected overburden pressure, so that a significant fraction of this pressure increment can be used to drive the return circulation against wall friction. Hence a second reason for stepping and also for a large hole diameter is circumvented.

A third reason for stepping is to step the size of the drill string in order to reduce the stress due to weight. If the formation and mud density are roughly 2, and the steel density is 8, then the difference is 6, so the stress in the drill string will be 3 times larger than overburden stress, or 90,000 psi at 30,000 feet depth. This is near the limit of usable working stress for steel, and so stepping of the drill string diameter is usually required at these great depths. On the other hand, a preferred embodiment of the present invention uses an overdense mud, roughly 2.2, to contain geopressurized zones, and in addition, a light density metal for the drill string. The alloy with the best strength to weight ratio and, in addition, high temperature properties, is titanium 4–6 (4% vanadium and 6% aluminum) which has a yield strength of 165,000 psi and density of 4.4. This means that the stress in the drill string, because of partial floating in the mud, will be roughly overburden stress, and so again no stepping is required to depths well beyond 30,000 feet.

The determinative consideration for a given size hole is the cooling and transport of cuttings from the drill bit. A maximum drilling rate in a favorable formation is 300 feet per hour, or 2.5 cm/second, with a mud loading of 3%. Accordingly, the mud circulation velocity is 33 times the area ratio of hole to circulation cross section. If the radii of the inside, outside of the drill string and hole are in ratio of 1.5:2.5:4, then the return velocity will be 0.23 of the down hole velocity and the pressure drop due to wall friction will be also 0.23 of the down hole pressure drop, i.e. $(\text{velocity})^2 \times$ wall area ratio. When the down hole pressure drop due to mud flow inside the drill string is 10,000 psi, the fluid return pressure drop is 2300 psi. If an additional drop of 2300 psi occurs at the bit for scouring, and a further 2000 psi is fluid return back pressure for the detection of fluid loss, then the mud pump must supply roughly 17,000 psi to the Kelly or top end of the drill string. This is 15% of the proposed drill string yield point of titanium 4–6 and a radius ratio of 1.5:2.5, and so reasonably conservative.

The mud fluid velocity can be calculated in the following fashion. The pressure drop of a fluid with "slick" additives and high Reynolds number is roughly $(\rho)$ velocity$^2/2$ per 100 diameters of length assuming a smooth wall. For example, consider a 4 inch (10 cm) hole diameter with a 1½ inch inside diameter drill string. In 30,000 feet there will be $3.6 \times 10^5/150 = 2400$ units of pressure drop along the string. If the total pressure drop along the string is the previously assumed 10,000 psi, then the flow velocity corresponds to 4 psi, or 5.5 meters per sec or 18 feet per sec. Multiplying by the area ratio of the drill string inside diameter to the hole diameter, the equivalent hole displacement velocity is 2.6 feet per second. The loading of the mud by cuttings at a drilling rate of 300 feet per hour is 3%, which is just marginal. The down hole time required to spot a stress fluid or thixotropic grout increment is then 2.5 minutes and the drill will have progressed 12 feet. During this period, the hole is stressed by periodic return shut in pressures roughly 20 times. This means that thixotropic grout is switched into the mud stream every 5 to 10 seconds. A computer can be advantageously used in controlling the mud and thixotropic fluid injection. The power required to drive the mud pump in this example is approximately 1000 Hp.

The casing prevents further fracturing of the formation during the multiple and periodic overstressing that occurs at the bottom hole. However, the casing need not support the maximum overstressing pressure, say of 30,000 psi, because the hole has been overstressed to this value along its length. Therefore, the casing must support only an additional increment of pressure, enough to ensure that if a particularly weak formation starts to stress relieve, the casing prevents further break-out. A reasonable estimate of the maximum yield stress that the casing might contain is then roughly one half of the overstress, or 15,000 psi in the current example. Since the casing is swaged into place, it is work hardened and a yield stress of 150,000 psi is expected. The thickness in the current example is then 1/10 of the radius, or 0.2 inches. As will be evident to those of skill in the art, this is a reasonable thickness and thickness ratio to swage into place.

Tubing is often swaged or expanded into place. The most usual example is the rolling of tubes into tube sheets of boilers or condensers where thousands of tubes are rolled - expanded - into their respective locations with high reliability against leakage or fracture. In these examples the fractional expansion of the tube is small, because the tube before expansion need only clear the tube sheet hole. According to the present invention, however, the casing tube must clear its own inside diameter, and so the fractional expansion is larger. This requires the metal to be more ductile and more completely annealed. In addition, the speed of expansion or swaging of the tube makes a large difference in the feasible expansion ratio, as is well known to those of skill in metal drawing operations. According to one embodiment of the present invention, the casing may be explosively swaged into place. The alternative method, as in the case of boilers, is to use a special roller assembly that is part of the bottom hole drill string and is activated for swaging the casing into place. Even in the case of explosive swaging, a light pass with rollers is desirable to ensure tight joints and adequate clearance. In either case, an expansion of 20% is entirely feasible considering ordinary metal working practice.

The casing string before expansion is assumed to be annealed and, therefore, ductile, with a low yield strength of about 50,000 psi, so that a relatively low pressure, about 5000 psi, will expand the tube. On the other hand, a mud layer is between the pre-expanded tubing and the wall of the bore hole. The swaging process must allow this mud layer to escape as the tube is being expanded; otherwise, the pressure required to expand the tube will be very much greater since the mud layer must expand into the formation by fracture in order to escape. Therefore, there will be an advantage for the phase of the expansion to progress slowly enough such that the mud can escape. The phase velocity corresponding to the minimum expansion pressure of 5000 psi is 200 meters per second. Slow explosives detonate at roughly 20 times this velocity, so the explosive is spirally wrapped inside the casing tube at a pitch corresponding to an angle of 20:1. A relatively narrow separation buffer between turns is enough to prevent detonation across turns, since only a relatively weak and slow explosive, such as nitroguanidine, is needed to give the modest required pressure. In addition, care must be taken to keep the explosive pressure to the modest value required for expansion of the casing so that the explosive pressure does not damage either the drill string or the overstressed hole.

BRIEF DESCRIPTION OF THE DRAWINGS

A more complete understanding of the invention and its advantages will be apparent from the following description of exemplary embodiments, taken in conjunction with the accompanying drawings, in which:

FIG. 1 is a diagrammatic view of a drilling apparatus in accord with the present invention;

FIG. 2 is an embodiment of a mechanism used in the roller swaging method of the present invention;

FIG. 3 is a diagrammatic view of the overstressing method according to the invention; and FIG. 4 is a sectional view of the explosive swaging method in accord with the present invention.

DESCRIPTION OF APPARATUS

A drill rig 10 is positioned above the bore hole 12. The two mud pumps 14 and 16 are of the special reversing kind and are of especially high pressure and power for overstressing the formation. Mud pump 14 draws from a mixing tank 18, which contains grout, and discharges into a tank 20. Mud pump 16 draws from a mixing tank 22, which contains mud, and discharges into tank 24. The mud or grout is injected into the drill string 25 through the Kelly 26, which is somewhat special since it must accommodate high pressure. The mud or grout return is blocked by a special shut-in packing gland 28 surrounding the drill stem 30 so that the returns are maintained under pressure through a line 32 to the letdown mud pump 16. At the bottom of the well, a standard drill bit 34 is used for drilling.

At the stage of the drilling operation shown in FIG. 1, the bit 34 is surrounded by a thixotropic grout 36 that is being forced into the formation to form and fill a fracture 38. A section or segment of grout 40 is depicted on its way down the drill string 25, having been loaded into the mud stream by the mud pump 14 drawing from the grout tank 18. In addition, similar fracture zones 42 are disposed along the length of the bore hole 12 corresponding to the sequential overstressing that has previously taken place during drilling. The casing 44 has been set in place in bore hole 12.

As shown in FIG. 2, the casing 44 has been run in and expanded into place in the wellbore 12. A length of casing 46 has been set in place but not expanded. The outside diameter of the casing 46 is such that it can easily clear the inside diameter of the expanded casing 44, and the inside diameter must, of course, clear the drill string 25. The casing 46 is in the process of expansion by three or more rollers 50. The mud 52 that lies in the annular space between the casing 46 and the overstressed drill hole wall 54 is forced downward by the closure 56, 56' and escapes at the end of the casing string 46. The rollers 50 rotate around the plug 64 and the shaft 58 as the drill string 25 is rotated from the rig 10. The roller mounting 60 is pivoted at 62 so that it can be forced by the tapered plug 64 against the casing wall 56. The tapered plug 64 is stored in the Kelly 26 for repeated use during casing operations, is forced down the drill string from the Kelly 26 by mud pressure from mud pump 16, and backed out by mud pressure from mud pump 14. When the tapered plug 64 is returned out of the drill string 25 to the Kelly 26, a subsequent increase in mud pressure from the mud pump 14 driving circulation through the drill bit 34 causes a pressure drop between the inside of the drill string 66 and the return space outside the drill string 68, causing the roller support arm 60 to be forced radially outward and retracting the rollers 50 into the drill string 25. The area and length of a roller support arm 60 is made larger than the corresponding area and length of a roller 50 relative to the support pivot 62 so that the net torque with a differential mud pressure retracts the rollers 50 and leaves the outside of the drill string 25 without a protrusion.

The drill string 25 is made of a lightweight alloy, such as titanium, 4–6 (4% aluminum and 6% vanadium), or even an aluminum alloy, so that the drill string 25 can partially float in the overdense mud, the use of which is made possible by the overstressing. Thus the tensile stress on the drill string 25 due to its own weight can be kept reasonably small.

FIG. 3 illustrates schematically the structure of an underground zone 68 that is in the process of being overstressed. The drill bit 34 attached to the drill string 25 has bored a bore hole 12 down to the zone 68. Several volumes of thixotropic cement 36 have been injected sequentially under high pressure through the drill string 25 and have passed out of the drill bit 34 to fracture the zone 68 with fractures 42. After fracturing, the thixotropic fluid 36 is held at a constant high pressure in which the fluid 36 flows into the cracks 42 of the subterranean formation 68. The overstressing of the subterranean formation 68 extends from 5 to 10 times the diameter of bore hole 12, in a preferred embodiment.

FIG. 4 illustrates an alternate embodiment of the present invention in which the casing is explosively swaged into place. A casing 44 has been previously placed in the well bore 12 and expanded. A casing section 46 is lowered through and positioned immediately below the previously set casing 44. Detonation of an explosive 48, such as nitroquanidine, spirally wrapped on the inside of the section 46 expands the section 46 to the same diameter as the section 44. The casing section 46 can be swaged with rollers (see FIG. 3) after expansion to insure a good fit with the previously set casing 44.

While more than one embodiment of the present invention has been described in detail herein and shown in the accompanying drawings, it will be evident that various further modifications are possible without departing from the spirit and scope of the invention.

I claim:

1. A method of preventing drilling fluid losses and blowouts during the drilling of a bore hole comprising the step of periodically and sequentially fracturing a zone at the bottom of the bore hole with a thixotropic fast-setting fluid and injecting such fluid into the zone to overstress the zone, the fracturing and injecting being periodic as a function of the progression of the drill, the volume of fluid injected in each injection being of the order of $r^3/300$ where r is a selected value for the extent of the fracture into the zone from the bore hole, the number of injections being from about two to about ten per each meter of drill progression, such injections being made along the entire extent of the well bore and the fluid having a gel strength Gs approximately equal to $(d\tau)^2/2B$ where $d\tau$ is a selected incremental stress to be added by each fracture and injection and B is the bulk modulus of the formation material, which the fluid fractures and into which the fluid is injected.

2. A method according to claim 1 and further comprising the step of casing the bore hole down to a distance above the bottom that is selected to minimize break-out and loss of drilling mud to previously prestressed zones.

3. A method according to claim 2 wherein the bore hole is cased with ductile and pre-annealed casing sections, each section being run in through the previously set casing and swaged in situ to a diameter large enough to allow the next section to be run through it.

4. A method according to claim 3 wherein each casing section is explosive-swaged using a ribbon of slow explosive spirally pre-wound inside the section at a pitch angle of the order of 1:20 so that the progressive phase velocity along the length of the casing is slower than the normal detonation velocity by the pitch angle and, therefore, the mud between the casing and the bore hole wall can escape ahead of the expanding section rather than being trapped.

5. A method according to claim 1 wherein the bore hole is drilled using a drill string made of a low density alloy and a high density drilling mud such that the drill string is partially floated.

6. A method according to claim 5 wherein the drill string is made of a titanium alloy.

7. A method according to claim 6 wherein the titanium alloy is titanium 4–6 (4% vanadium and 6% aluminum).

8. A method according to claim 5 wherein the drilling mud has a specific gravity of not less than about 2.0.

9. A method of setting casing in a bore hole comprising the step of lowering each casing length through previously set casing and swaging the section to expand it to a diameter large enough to allow the next casing section to pass down through it, each casing section being explosive-swaged using a ribbon of slow-explosive spirally pre-wound inside the section at a pitch angle of the order of 1:20 so that the progressive phase velocity along the length of the casing is slower than the normal detonation velocity by the pitch angle and, therefore, the mud between the casing and the bore hole wall can escape ahead of the expanding section rather than being trapped.

10. A method according to claim 9 wherein the explosive is nitroguanidine.

11. A method of swaging a casing in a bore hole comprising the steps of affixing to the inside wall of the casing a ribbon of slow explosive spirally wound at a pitch angle of about 1:20 so that the progressive phase velocity along the length of the casing is slower than the normal detonation velocity by the pitch angle and, therefore, mud between the casing and the bore hole wall can escape ahead of the expanding casing rather than being trapped, and igniting the upper end of the explosive to cause the explosion to detonate progressively downward and generates pressure that progressively expands the casing radially outwardly with respect to the axis of the bore hole.

12. A method of drilling a bore hole comprising the step of sequentially overstressing zones adjacent the bottom of the hole preiodically fracturing the zone with a thixotropic fast-setting fluid and injecting such fluid into the zone at a rate of from about 2 to about 10 fractures and injections per meter of drill progression and periodically running casing down to within several casing lengths of the bottom of the hole to prevent fluid loss in the previously drilled and overstressed portion of the hole during the overstressing of the zone adjacent the bottom of the hole, the fluid having a gel strength Gs approximately equal to $(d\tau)^2/2B$ where $d\tau$ is a selected incremental stress to be added by each fracture and injection and B is the bulk modulus of the formation material which the fluid fractures and into which the fluid is injected, and the hole being cased at a constant diameter by running each casing length down within the previously set casing and swaging said casing length to a diameter large enough to enable the next casing length to pass down through it.

13. A method according to claim 12 wherein the overstressed zone is stressed to a pressure roughly equal to the overburden pressure at the full depth of the bore hole, and wherein the overstress zone extends from about 5 to about 10 bore diameters out from the bore hole.

14. A method according to claim 12 wherein the swaging step includes the steps of prewinding a ribbon of slow explosive spirally inside the section at a pitch angle of the order of 1:20 so that the progressive phase velocity along the length of the casing is slower than the normal detonation velocity by the pitch angle and, therefore, the mud between the casing and the bore hole wall can escape ahead of the expanding section rather than being trapped, and igniting the upper end of the explosive to cause an explosion to detonate progressively downward and generate pressure that progressively expands the casing radially outwardly with respect to the axis of the bore hole.

15. A method according to any of claims 12, 13 or 14 wherein the bore hole is drilled using a drill string made of a low density alloy and high density drilling mud such that the drill string is partially floated.

* * * * *